US007246436B2

(12) United States Patent
Blomgren et al.

(10) Patent No.: US 7,246,436 B2
(45) Date of Patent: Jul. 24, 2007

(54) PLATE PACKAGE, METHOD OF MANUFACTURING A PLATE PACKAGE, USE OF A PLATE PACKAGE AND PLATE HEAT EXCHANGER COMPRISING A PLATE PACKAGE

(75) Inventors: Ralf Blomgren, Skanor (SE); Jan Gronwall, deceased, late of Lomma (SE); by Kristina Gronwall, legal representative, Lomma (SE)

(73) Assignee: Alfa Laval Corporate AB, Lund (SE)

( * ) Notice: Subject to any disclaimer, the term of this patent is extended or adjusted under 35 U.S.C. 154(b) by 263 days.

(21) Appl. No.: 10/494,157

(22) PCT Filed: Dec. 13, 2002

(86) PCT No.: PCT/SE02/02325

§ 371 (c)(1),
(2), (4) Date: Mar. 1, 2005

(87) PCT Pub. No.: WO03/058142

PCT Pub. Date: Jul. 17, 2003

(65) Prior Publication Data

US 2005/0178536 A1 Aug. 18, 2005

(30) Foreign Application Priority Data

Dec. 17, 2001 (SE) ..... 0104254

(51) Int. Cl.
*B21D 53/04* (2006.01)

(52) U.S. Cl. ..... 29/890.039; 165/166; 165/167; 165/906

(58) Field of Classification Search ..... 165/166, 165/167, 906; 29/890.039, 890.042
See application file for complete search history.

(56) References Cited

U.S. PATENT DOCUMENTS

| | | | | |
|---|---|---|---|---|
| 3,458,917 | A | 8/1969 | Mueller | |
| 4,014,385 | A | 3/1977 | Wright | |
| 4,411,310 | A | 10/1983 | Perry et al. | |
| 5,222,551 | A * | 6/1993 | Hasegawa et al. | 165/167 |
| 5,287,918 | A | 2/1994 | Banks et al. | |
| 5,307,869 | A * | 5/1994 | Blomgren | 165/167 |
| 5,383,518 | A * | 1/1995 | Banks et al. | 165/166 |
| 5,505,256 | A | 4/1996 | Boardman et al. | |

FOREIGN PATENT DOCUMENTS

EP 0 928 941 7/1999

* cited by examiner

*Primary Examiner*—Leonard R. Leo
(74) *Attorney, Agent, or Firm*—Fish & Richardson P.C.

(57) ABSTRACT

The invention refers to a plate package for a plate heat exchanger, a method for manufacturing a plate package, a use of a plate package, and a plate heat exchanger. The plate package includes a plurality of heat exchanger plates (1), which are stacked on each other and which each includes a number of portholes. The plates (1) are compression molded and permanently connected to each other in a number of joints in such a manner that the plates between each other form a first passage for a first fluid and a second passage for a second fluid. The plate package is designed to permit at least one of the fluids to flow through the respective passages at a predetermined maximum working pressure. The plate package has an increased strength achieved by subjecting at least one of the passages to at least a local inner plastic deformation of the plate package.

12 Claims, 4 Drawing Sheets

PLATE PACKAGE, METHOD OF MANUFACTURING A PLATE PACKAGE, USE OF A PLATE PACKAGE AND PLATE HEAT EXCHANGER COMPRISING A PLATE PACKAGE

BACKGROUND OF THE INVENTION AND PRIOR ART

The present invention refers to a plate package for a plate heat exchanger, which package includes a plurality of heat exchanger plates, which are stacked on each other and which each includes a number of portholes, wherein the plates are compression moulded and permanently connected to each other in a number of joints in such a manner that the plates between each other form a first passage for a first fluid and a second passage for a second fluid, wherein the plate package is designed to permit at least one of said fluids to flow through the respective passages at a predetermined maximum working pressure. The invention also refers to a method for manufacturing a plate package for a plate heat exchanger, which package includes a plurality of heat exchanger plates, which are stacked on each other and which each includes a number of portholes, wherein the plates are compression moulded in such a manner that the plates in the plate package between each other form a first passage for a first fluid and a second passage for a second fluid and wherein the plate package is designed to permit at least one of said fluids to flow through the respective passages at a predetermined working pressure. Furthermore, the invention refers to a use of a plate package, and a plate heat exchanger.

Such plate packages are used in plate& heat exchangers for a plurality of various applications. The plates are normally manufactured in stainless steel and permanently connected to each other by brazing. As braze material copper is normally used. Such plate packages and plate heat exchangers have very high explosion pressures, i.e. they withstand very high inner pressures in one or several of the passages without braking of the plate package. The high explosion pressures are achieved thanks to the high ductility of the used materials and the capability of the materials to obtain a high yield limit through cold working. The explosion pressure may also be increased by increasing the sheet thickness of the heat exchanger plates, the pressure plate and the frame plate.

There is of course a general interest of increasing the strength of such plate packages. In addition, in such plate packages, a certain spread in the pressure fatigue quality arises since the permanent connection between adjacent plates in certain joints could be defect or possible be partly missing. During use of a plate package in a heat exchanger, the plate package is frequently subjected to pulsating pressure, wherein the highest pressure pulses define, and are not permitted to exceed, the highest permitted working pressure. These high pressure pulses lead to high stresses in such defect joints and in joints around defect joints or around areas where the joints are partly missing for any reason. High stresses are of course also present in all highly loaded areas even if the joints are free from defects.

During the manufacture of such plate packages, a pressure test of the plate package takes place today before delivery thereof. Such a pressure test typically takes place at a test pressure corresponding to 1,3-1,8× the maximum working pressure depending on pressure vessel code, operation conditions, i. e. the strength of the material at the designed temperature in relation to the strength at the test pressure temperature. If the plate package withstands this pressure, the quality is regarded to be sufficient. The test pressure level is such that it does not give rise to any visible or measurable plastic deformation of the materials in the-plate package.

U.S. Pat. No. 3,458,917 discloses a way of manufacturing another type of plate heat exchanger. Two substantially plane plates are laid adjacent to each other and joined to each other at point- or line-shaped weld joints. Thereafter a deformation pressure is supplied by the supply of a pressurised medium to the interspace between adjacent plates. The deformation pressure is such that the plates will be deformed and obtain a wavy shape. In such a way, the desired passage between the plates is created.

SUMMARY OF THE INVENTION

The object of the present invention is to provide a plate package for a plate heat exchanger with an increased fatigue strength.

This object is achieved by the initially defined plate package, which is characterised in that it has an increased strength achieved by subjecting at least one of said passages to at least a local inner plastic deformation.

By such a prepressing the stresses in both the plates and the joints will increase, and it is possible to exceed the yield limit of the material in certain points or areas. In these points or areas a plastic deformation thus arises, which leads to a decrease of the stress in these points or areas after the pressure again has been lowered to a normal level. During use of the plate package, these points or areas will be subjected to a reduced load, and adjacent points or areas will absorb a larger part of the load that arises. After the prepressing according to the present invention, it is thus possible to obtain favourable rest stresses in the form of pressure stresses in the most loaded area of the plate package. The plate package may for instance include the materials copper and stainless steel, which have a high ductility, and if these materials are used in the plate package the desired condition with an equalised inner stress in the plate package is thus obtained prior to failure of the plate package in the most loaded point or points.

By the prepressing according to the invention, a plastic deformation is thus aimed at, but this deformation does not need to be as large that it is recognisable with the naked eye. After such a prepressing of the plate package, it is however possible to study the plastic deformation by means of any appropriate analysing equipment in order to establish that a plastic deformation has taken place. After the prepressing, the plate package may also be analysed in order to discover directly if certain joints are defect or missing by studying the plastic deformation around the joints. The plastic deformation may take place in the plate and/or in the material by which the plates are connected to each other.

By the proposed prepressing, it is possible to prolong the life of the plate package at pressure cycling to a low cost. For certain products, which already today have a sufficient life, it is instead, thanks to the invention, possible to dispense with a frequently used pressure plate against which the plate package is arranged.

Furthermore, by the prepressing according to the invention a smaller spread in the life due to pressure fatigue is achieved. The equalisation of stresses inherent in the plate package leads to the advantage that pulsating pressures and stress peaks arising during use of the plate package are equalised and distributed over a larger part of the plate package.

According to an embodiment of the invention, said plastic deformation is achieved by expanding the plate package from inside, i. e. the plates are pulled in a direction from each other. Normally, said local deformation will appear in the proximity of said portholes. The area around the portholes is a critical part of a plate package of a plate heat exchanger. It is therefore advantageous if a plastic deformation may be obtained in or in the proximity of the porthole. At least one of said joints of adjacent plates are located in the proximity of said porthole, and thus said local deformation in an advantageous manner is provided at and/or in this joint. The deformation may refer to a material by which the joint is made and/or the material in the plates.

According to a further embodiment of the invention, said deformation is achieved by pressurising a supplied medium to a treatment pressure which significantly exceeds the working pressure. By such a pressurising, the plastic deformation may be achieved in a simple and controllable manner.

According to a further embodiment of the invention, the treatment pressure exceeds the working pressure by a factor that is at least 2.

Preferably the treatment pressure exceeds the working pressure by a factor that is at least 3, and more preferably by a factor that is at least 4.

According to a further embodiment of the invention, the plates are connected to each other by brazing.

The object is also achieved by the initially defined method, which is characterised by the steps of: attaching the plates to each other in a number of joints in such a manner that a permanent joining of the plate package is achieved, and providing at least one local inner plastic deformation of the plate package in such a manner that the plate package obtains an increased strength.

The object is also obtained by a use of a plate package manufactured according to this method, a use of a plate package as defined above, and a plate heat exchanger including a plate package as defined above.

BRIEF DESCRIPTION OF THE DRAWING

The present invention is not to be explained more closely by a description of various embodiments and with reference to the drawings attached.

DETAILED DESCRIPTION OF VARIOUS EMBODIMENTS OF THE INVENTION

Figure 1:
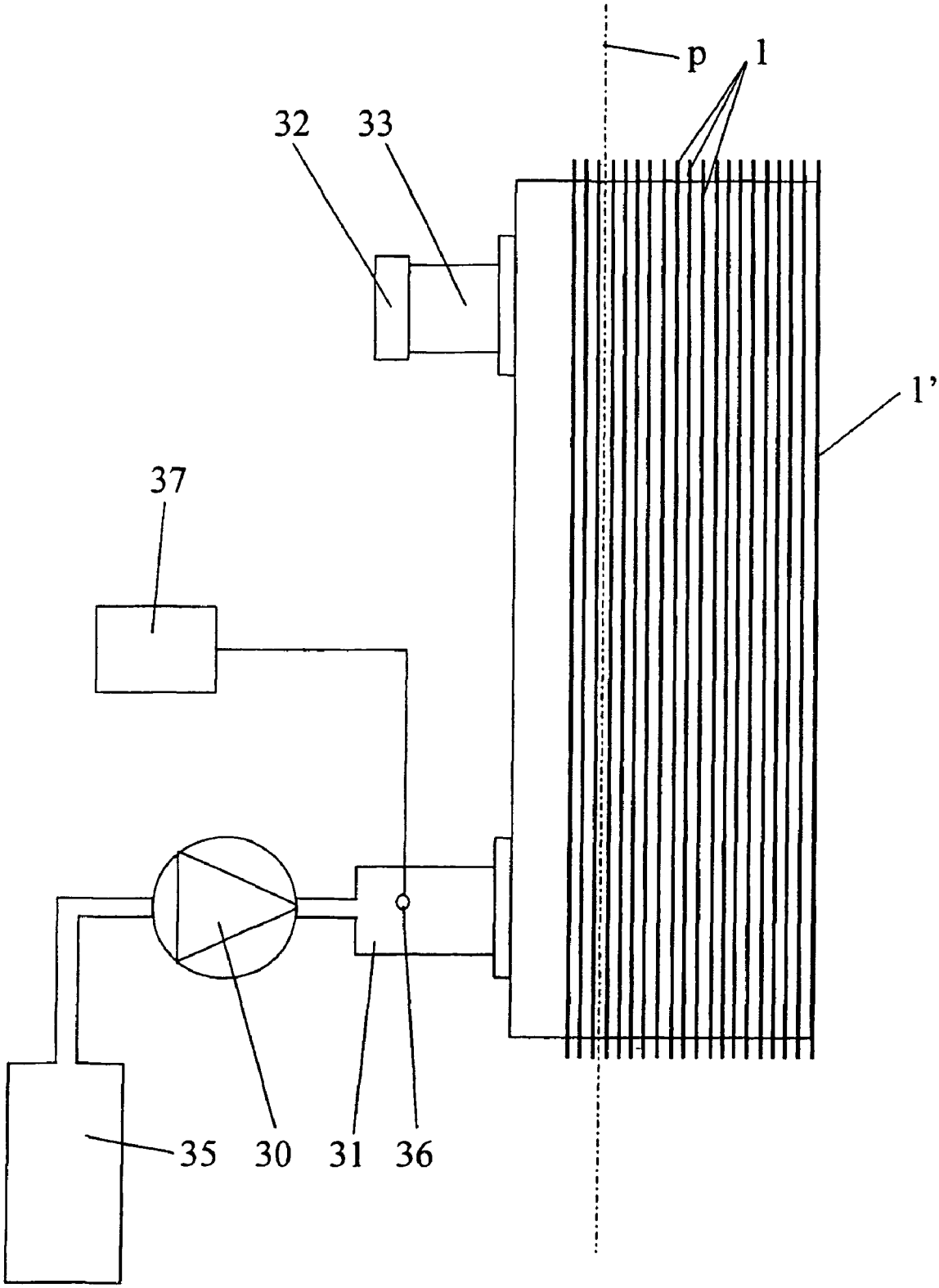
FIG. 1 discloses schematically a side view of a plate heat exchanger according to the invention.

FIG. 1 discloses a plate heat exchanger including a plate package, which includes a plurality of heat exchanger plates 1. Such a plate 1 is disclosed more closely in FIG. 2. The plate 1 is manufactured of a ductile material, preferably stainless steel. In the embodiment disclosed, each plate 1 includes four portholes 2', 2". Each plate 1 includes a main extension plane p and a corrugation 3 of ridges and valleys. The corrugation 3 has been achieved by compression moulding the plates 1. In the embodiment disclosed, the ridges and valleys extend according to a herring-bone pattern, i. e. they are inclined by a determined angle to a longitudinal centre axis x of the plate 1.

Figure 2:
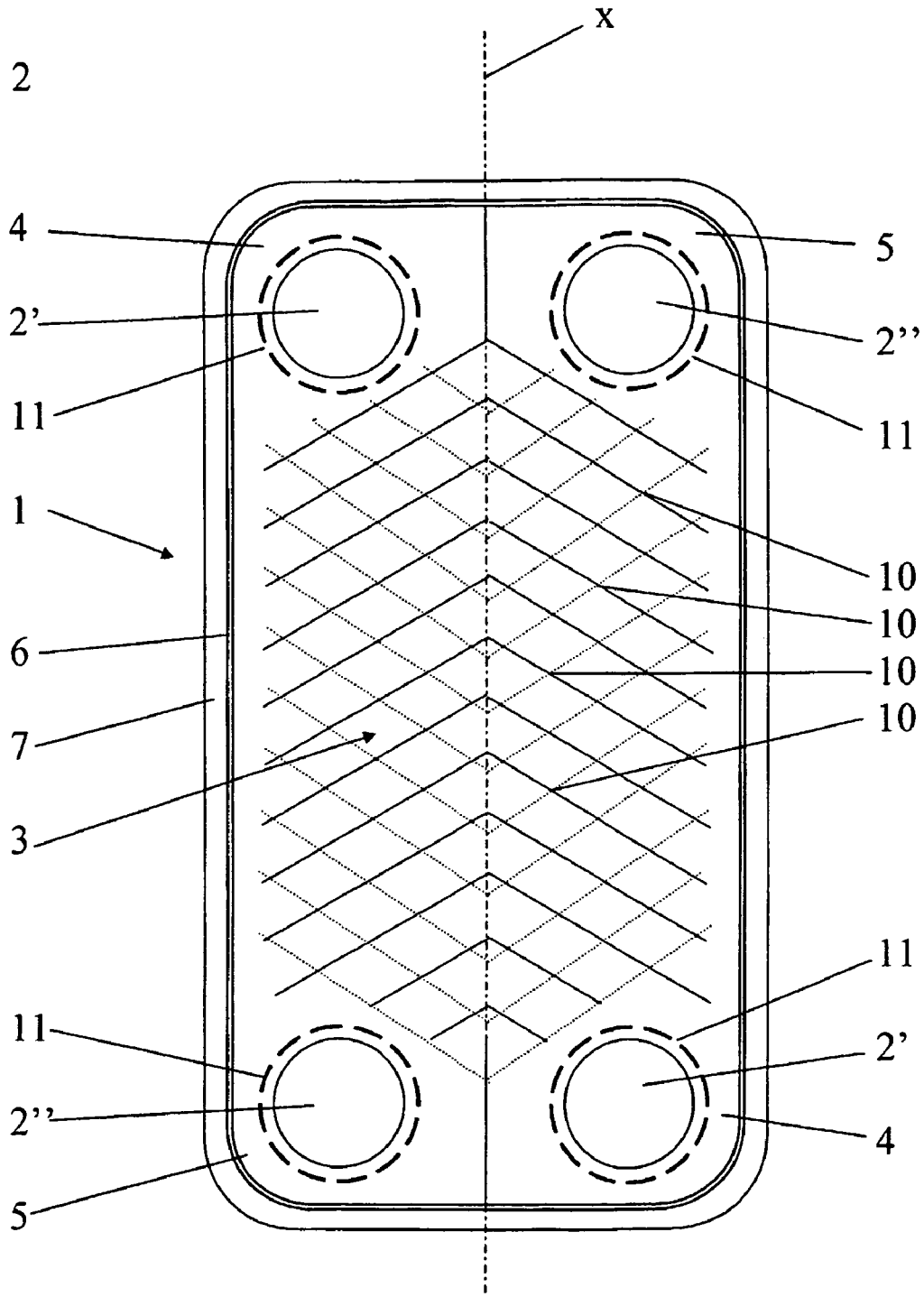
FIG. 2 discloses schematically a heat exchanger plate for a plate package according to the invention.

Substantially all plates 1 in the plate package are identical and the portholes 2', 2" form four port channels extending through the plate package. The plates 1 are however stacked on each other in such a way that the corrugation 3 of every second plate points in a first direction and every other plate in a second opposite direction. In FIG. 2, it appears by continuos lines how the corrugation 3 extends in the plate 1. By dotted lines, the corrugation 3 of an adjacent rotated plate is indicated. The continuous and dotted lines represent a ridge and/or a valley depending on from which direction they are seen. When the plates 1 are stacked on each other in this alternating order, the valleys of the plate 1 in FIG. 2 will be supported by the ridges of the most closely underlying plate 1. In such a way, a plurality of support points are obtained between the plates 1. Furthermore, the area most closely to the portholes 2' is located at a level which corresponds to a valley of the corrugation 3, compare FIG. 4, whereas the area 5, which is located most closely to the porthole 2", is located at a level corresponding to a ridge of the corrugation 3. When every second plate 1 is rotated 180° and the plates 1 are stacked on each other, the area 4 will thus abut the area 5 of the closest underlying plate, which appears from FIG. 4. Each plate 1 also has a sloping edge area 6 and a flange 7 extending outwardly from a lower part of the edge area 6 in a plane which is substantially in parallel with the main extension plane p of the plate 1.

During the manufacturing of the plate package, the plates 1 are thus stacked on each other in the alternating order mentioned above. A folio or a paste of a braze material including a suitable metal or metal alloy is applied between each plate. In the embodiment, disclosed copper is used. The plates 1 are kept together and the plate package is heated to the melting temperature of the braze material during a suitable period of time. The plates 1 will then be connected permanently to each other, and joints 10, 10' between the ridges and valleys of the corrugations 3, joints 11 around the portholes 2', 2" between the areas 4 and 5, and joints 12 between the sloping edge areas 6, are formed.

Figure 3:
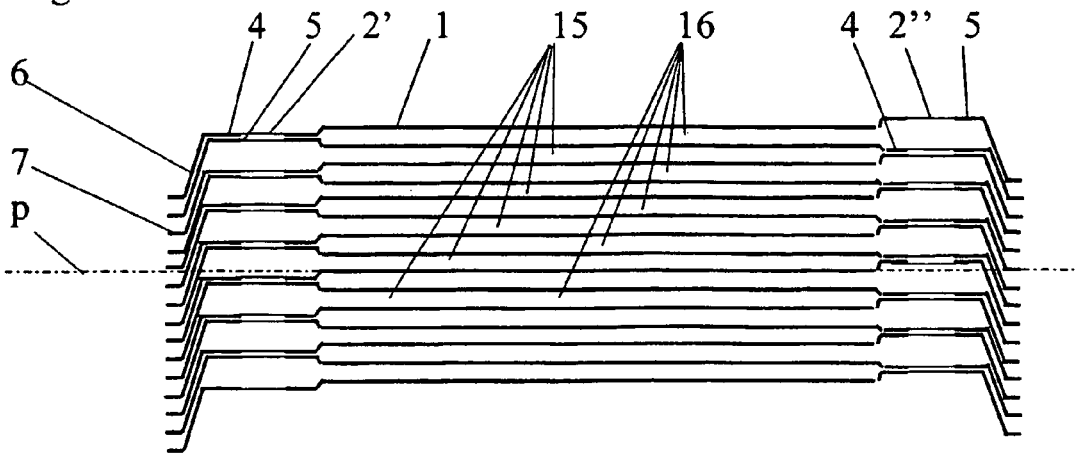
FIG. 3 discloses schematically a sectional view of a plate package constructed of heat exchanger plates according to FIG. 2.
Figure 4:
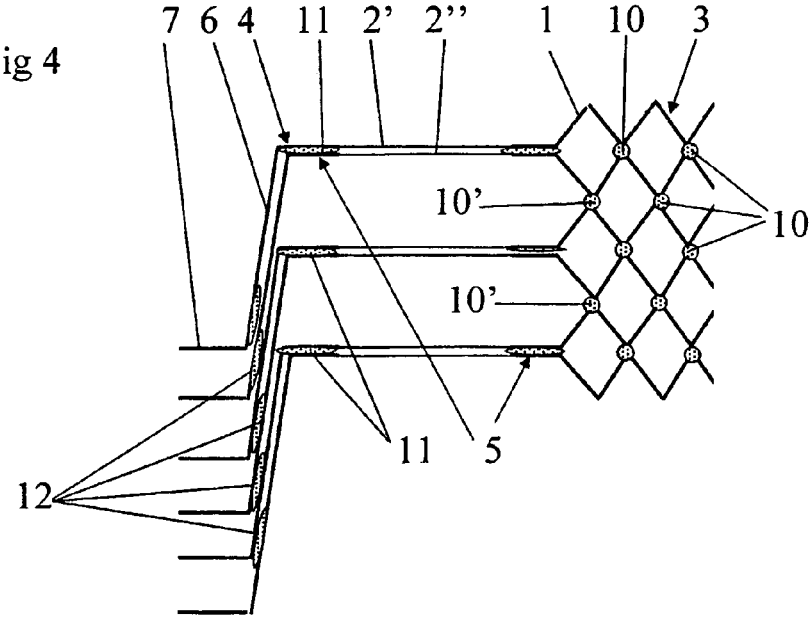
FIG. 4 discloses schematically a sectional view of an area around a port channel of the plate package in FIG. 3.

As appears from FIGS. 3 and 4, interspaces are formed between adjacent plates 1 in the joined plate package. The interspaces form a first passage 15 between two of the portholes 2' and a second passage 16 between the two other portholes 2". The plates 1 are arranged in such a way that every second interspace is associated to the first passage 15 and every other interspace to the second passage 16. The first passage 15 is intended for a first medium and a second passage 16 for a second medium. The plate package and the plate heat exchanger are designed to permit a highest working pressure for the first medium and/or the second medium.

When the plate package has been brazed, as defined above, at least one of the passages 15, 16 is subjected to a prepressing at a treatment pressure which significantly exceeds the working pressure. FIG. 1 discloses schematically an equipment for such a prepressing of one of the passages 15, 16. It is to be noted that both the passages 15, 16 may be prepressed by such an equipment. In the latter case, the prepressing of both the passages may be made simultaneously or successively.

The equipment includes a pump 30 or the like which is connected to one of the passages 15 and 16 via a pipe connection 31. The passage 15, 16 in question is closed at the other end by means of a cover 32 or the like, which is provided on a pipe connection 33 to the passage 15, 16 in question. By means of the pump 30, a medium from a source 35 is supplied into the first passage 15 or the second passage 16. Said medium may be any suitable gas or liquid. Suitably, a pressure sensor 36 is provided in the pipe connection 31 for enabling reading and/or recording of the applied treatment pressure by means of a display member and/or a recording member.

The treatment pressure is chosen in such a way that it produces at least one local inner plastic deformation in the plate package. By inner plastic deformation it is referred to a deformation in the material in the plates 1 and/or any of the braze joints 10, 10', 11, 12. Such an inner plastic deformation does not need to be visible with the naked eye, but may be established by any suitable material analysing equipment.

The braze joints 10', 11 around the portholes 2', 2" are particularly critical since these areas lack the plurality of support points present in the corrugated area of the plate. It is therefore desirable to produce such a plastic deformation of the joints 10' and the plate material in the proximity of the portholes 2', 2".

The treatment pressure should significantly exceed the working pressure mentioned above, for instance by a factor that is at least 2, preferably at least 3 and specifically at least 4. By such a treatment pressure, a pressure is ensured, which results in exceeding of the yield limit of the material and thus in an initiating of a plastic deformation. The treatment pressure thus depends on the maximum working pressure. For instance, the treatment pressure may in absolute numbers amount to at least 20 bars, at least 30 bars, at least 40 bars or at least 50 bars. In certain applications where the maximum working pressure is much higher, the treatment pressure may be even higher than the levels defined.

Normally a plate package or a plate heat exchanger is pressure tested prior to use. The test pressure is about 1,3-1,8× the maximum working pressure. Since the treatment pressure significantly exceeds such a test pressure, it is according to the invention possible to dispense with such a pressure test according to the prior art. A pressure test may however also be performed by the supply of a medium pressurised to a determined test pressure, which exceeds the working pressure but which suitably is lower than the treatment pressure.

Figure 5:
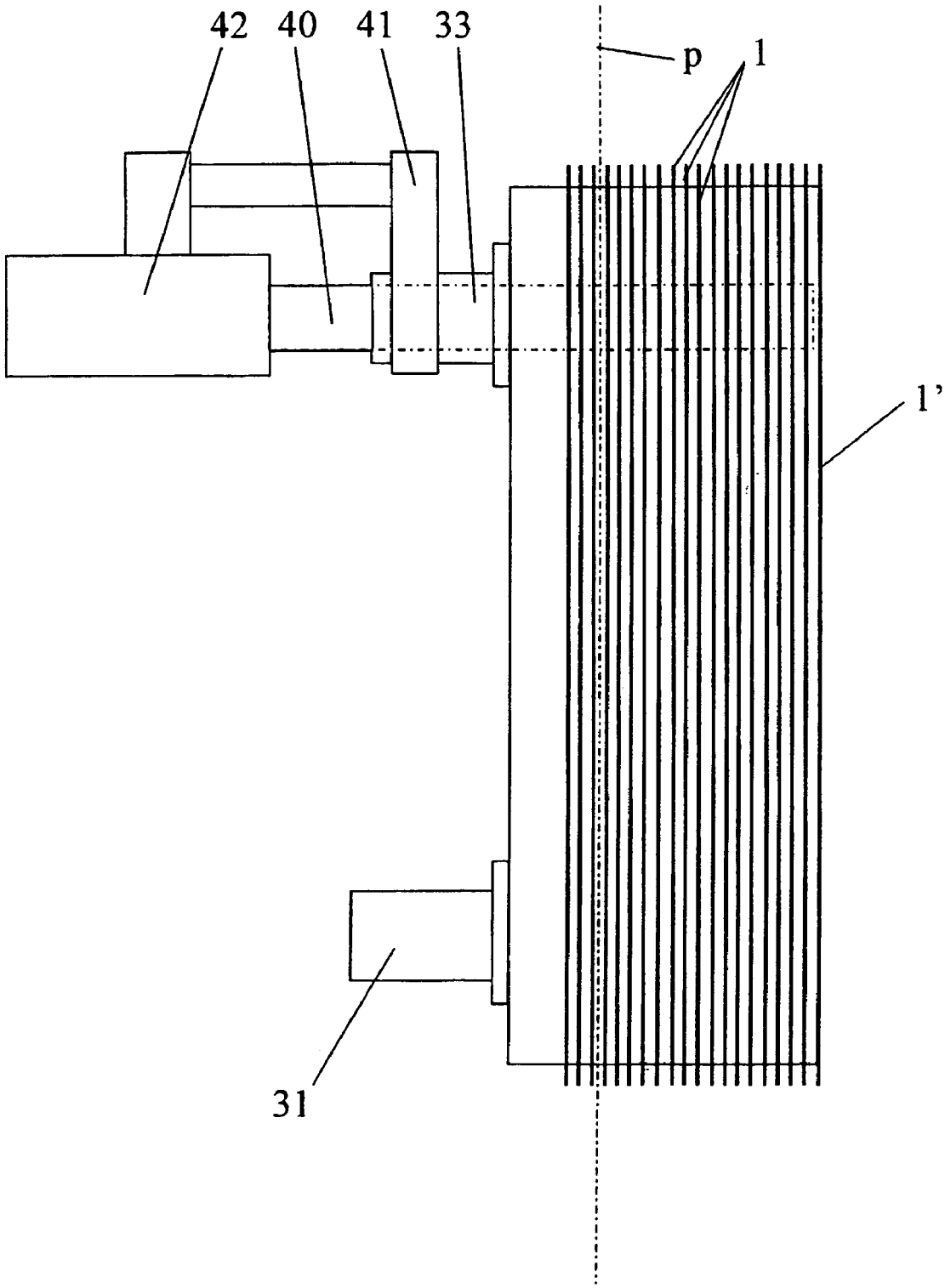
FIG. 5 discloses schematically a side view of a plate heat exchanger manufactured according to an alternative method.

FIG. 5 discloses an alternative way of producing the desired plastic deformation. A piston 40 is introduced into a port channel via a pipe connection 33. A holding-up member 41 is attached around the pipe connection 33, and thereafter a pressure force is applied to the piston 40 by means of for instance a hydraulic or pneumatic cylinder 42. The force will act against the outermost pressure plate 1', and the plates 1 will be pulled apart in a similar manner as if a supplied medium would have been pressurised.

The invention is not limited to the embodiments disclosed but may be varied and modified within the scope of the following claims. The invention is also applicable to plate packages and plate heat exchangers where the plates are permanently connected to each other in another manner than by braze joints, for instance by welding. A plate package may also be designed in such a way that the interspaces between the plates 1 form three or several separate passages. In particular, when such a plate package includes a so-called partition wall between two passages large loads arise in the port area close to the partition wall.

The invention claimed is:

1. A method for manufacturing a plate package for a plate heat exchanger, said package comprising a plurality of heat exchanger plates, which are stacked on each other and which each includes a number of portholes, wherein the plates are compression molded in such a manner that the plates in the plate package between each other form a first passage for a first fluid and a second passage for a second fluid and wherein the plate package is designed to permit at least one of said fluids to flow through the respective passages at a predetermined working pressure, comprising:

attaching the plates to each other in a number of joints in such a manner that a permanent joining of the plate package is achieved, and providing at least one local inner plastic deformation of the permanently attached plate package in such a manner that the plate package obtains an increased strength.

2. A method according to claim 1, wherein said plastic deformation is achieved by expanding the plate package from inside.

3. A method according to claim 1, wherein said local deformation appears in the proximity of said portholes.

4. A method according to claim 3, wherein adjacent plates are attached to each other along at least one common joint which is located in the proximity of said portholes, and wherein said local deformation is provided at and/or in said joint.

5. A method according to claim 1, wherein said deformation is provided by the application of a force which pulls apart the plates.

6. A method according to claim 1, wherein said deformation is provided by the supply of a medium, which is pressurized to a treatment pressure that significantly exceeds the working pressure, to a least one of said passages.

7. A method according to claim 6, wherein said medium is pressurized to a treatment pressure that exceeds the working pressure by a factor that is at least 2.

8. A method according to claim 6, wherein said medium is pressurized to a treatment pressure that exceeds the working pressure by a factor that is at least 3.

9. A method according to claim 6, wherein said medium is pressurized to a treatment pressure that exceeds the working pressure by a factor that is at least 4.

10. A method according to claim 5, wherein said force is supplied by means of a piston which is introduced into a port channel in the plate package.

11. A method according to claim 1, wherein the plates are attached to each other by brazing.

12. A method according to claim 1, further comprising:

supplying a medium which is pressurized to a determined test pressure that exceeds the working pressure but is lower than a treatment pressure.

* * * * *